US006719168B2

(12) United States Patent
Nicolini

(10) Patent No.: US 6,719,168 B2
(45) Date of Patent: Apr. 13, 2004

(54) CONTROLLED OUTPUT AUTOMATIC PRODUCT DISPENSING MACHINE

(75) Inventor: Antonio Nicolini, Schio (IT)

(73) Assignee: Officine Meccaniche F.lli Manea S.r.l., Zane' (IT)

( * ) Notice: Subject to any disclaimer, the term of this patent is extended or adjusted under 35 U.S.C. 154(b) by 72 days.

(21) Appl. No.: 10/114,002

(22) Filed: Apr. 1, 2002

(65) Prior Publication Data

US 2002/0145003 A1 Oct. 10, 2002

(30) Foreign Application Priority Data

Apr. 5, 2001 (IT) ..... M12001A0727

(51) Int. Cl.[7] ..... G07F 11/00
(52) U.S. Cl. ..... 221/85; 221/191
(58) Field of Search ..... 221/7, 9, 13, 129, 221/131, 191, 85

(56) References Cited

U.S. PATENT DOCUMENTS 4,108,333 A * 8/1978 Falk et al. ..... 221/13

FOREIGN PATENT DOCUMENTS

JP 3-189897 * 9/1991

* cited by examiner

*Primary Examiner*—Kenneth W. Noland
(74) *Attorney, Agent, or Firm*—Hedman & Costigan, P.C.

(57) ABSTRACT

A controlled output automatic product dispensing machine, comprising a fixed structure (13) with at least one shelf (10) holding at least one product-carrying drawer (11) and with at least one door (12) to collect the selected product. Said machine provides at least one guide (15) to slide a container (14) which collects the selected product near the corresponding product carrying drawer (11) and moves it to a collecting position accessible to the user after opening the door (12).

6 Claims, 5 Drawing Sheets

CONTROLLED OUTPUT AUTOMATIC PRODUCT DISPENSING MACHINE

Figure 1:
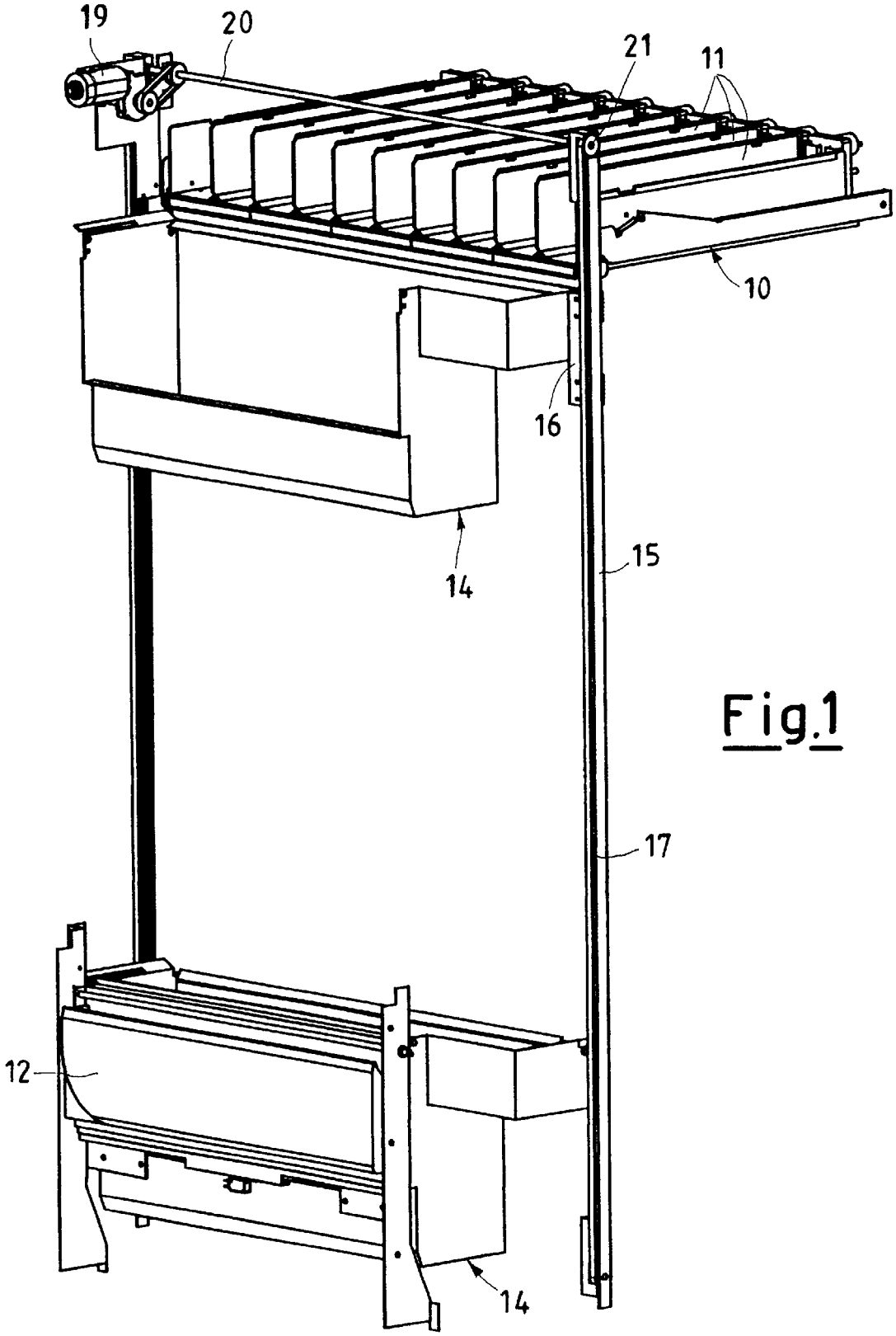

This invention refers to a controlled output automatic product dispensing machine.

For large-volume packaged consumer products, such as cans, bottles, foodstuffs, pharmaceuticals and the like, automatic machines are available for dispensing said products after a user's selection and subsequent payment.

At this time and following the user's selection and payment of a certain available product, these machines internally locate the chosen product, which is arranged in an appropriate drawer of an internal shelf of the machine. The machine then allows it to drop by gravity into an underlying collecting pocket, whence the user retrieves it by hand.

The pocket is closed by an openable door, such as for instance a push-in door, and provides for a simple anti-intrusion system preventing a manual access to the dispenser's internal drawers.

In the described system, the products paid out from the topmost internal drawers, especially those of a more delicate nature, may obviously encounter considerable dispensing problems.

In addition to the possible jamming of the selected product during its descent, there's a risk of damaging the product itself, glass bottles for instance, due to its falling height.

Moreover, even cans of carbonated drinks suffer some considerable shaking-up while falling, so that at their subsequent opening the internally compressed gas induces a partial spillage of the beverage.

The general purpose of this invention it to prevent the uncontrolled payout of the products dispensed by an automatic machine, which may jam while falling toward the collecting pocket, or suffer damage while falling into the collecting pocket itself.

Another purpose is to develop an anti-intrusion system in the collecting pocket, capable of preventing the access to the product carrying drawers.

In view of the mentioned purposes according to this invention, it was decided to produce a controlled output automatic product dispensing machine with the characteristics outlined in the attached claims.

The structural and functional characteristics of this invention and its advantages in comparison to the known art will become even clearer and better evident from a review of the following description in reference to the attached drawings, which illustrate a transport system in accordance with the innovative principles of the invention.

Figure 2:
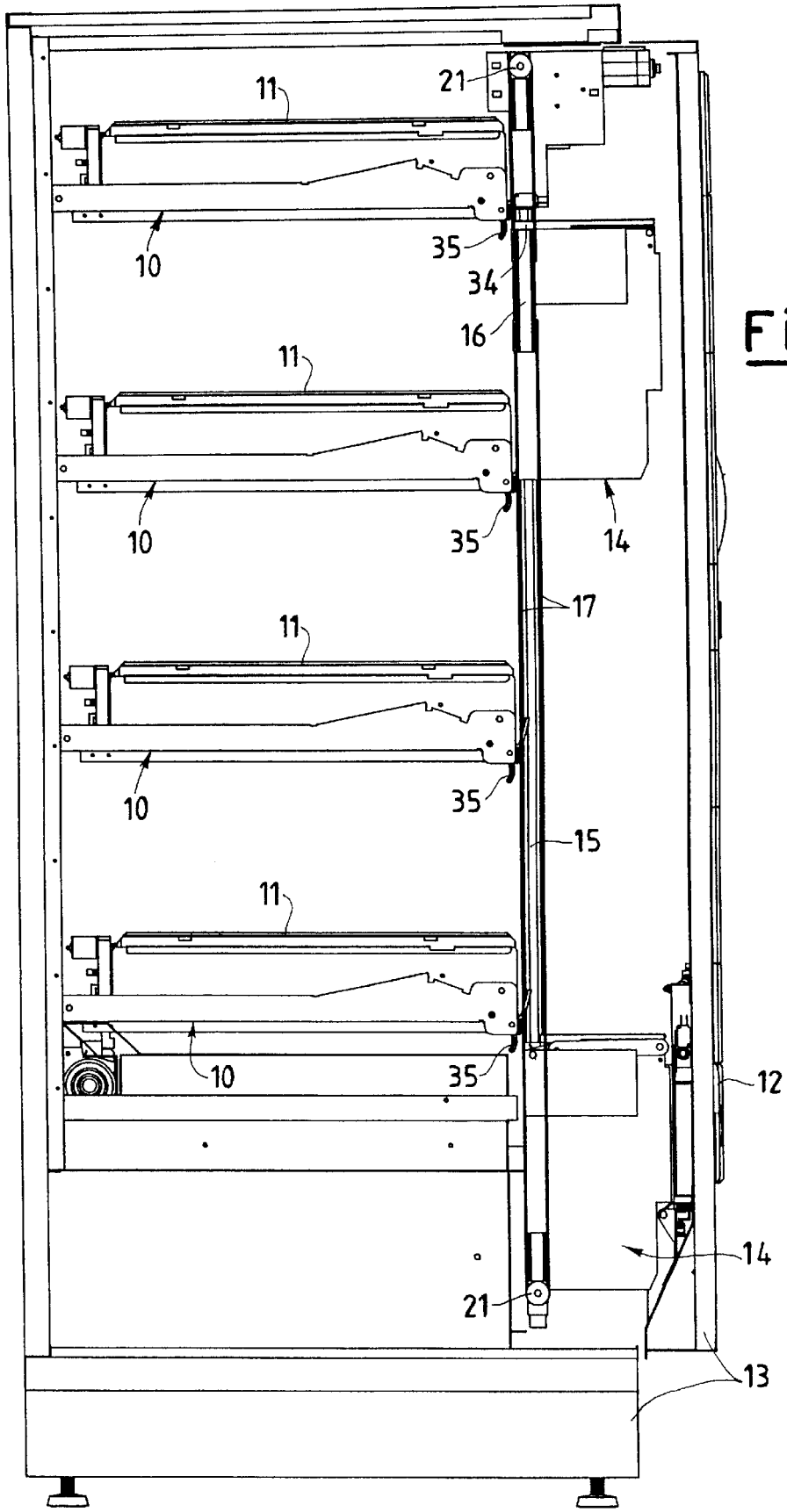
Figure 3:
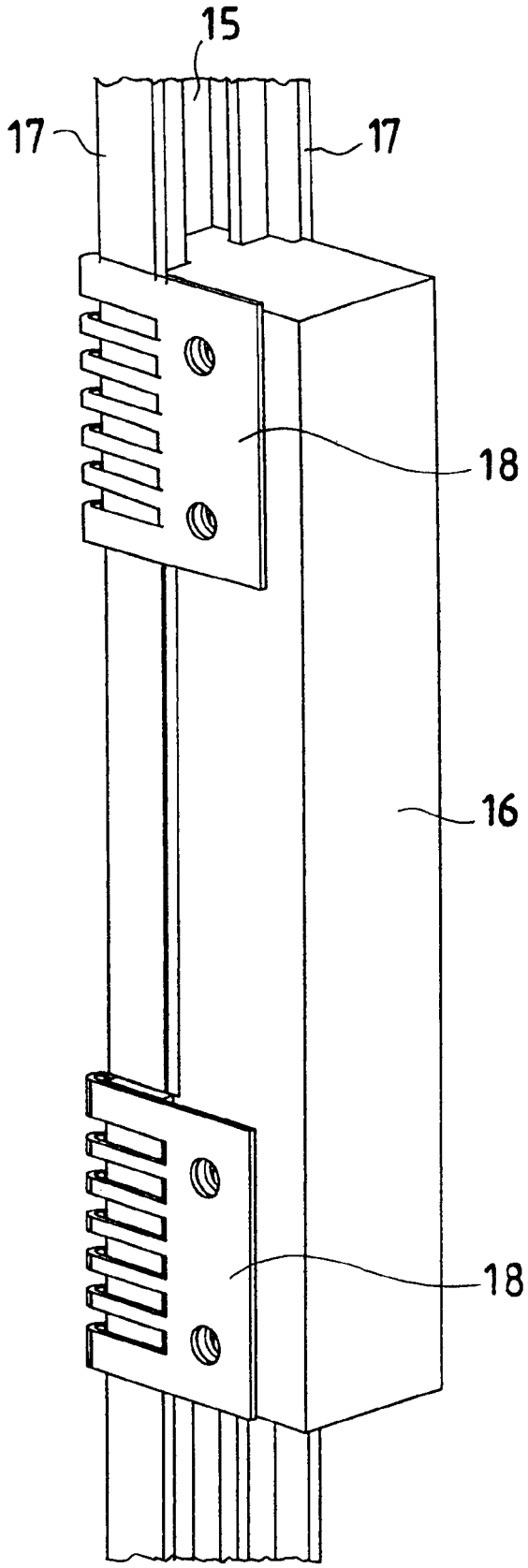
Figure 4:
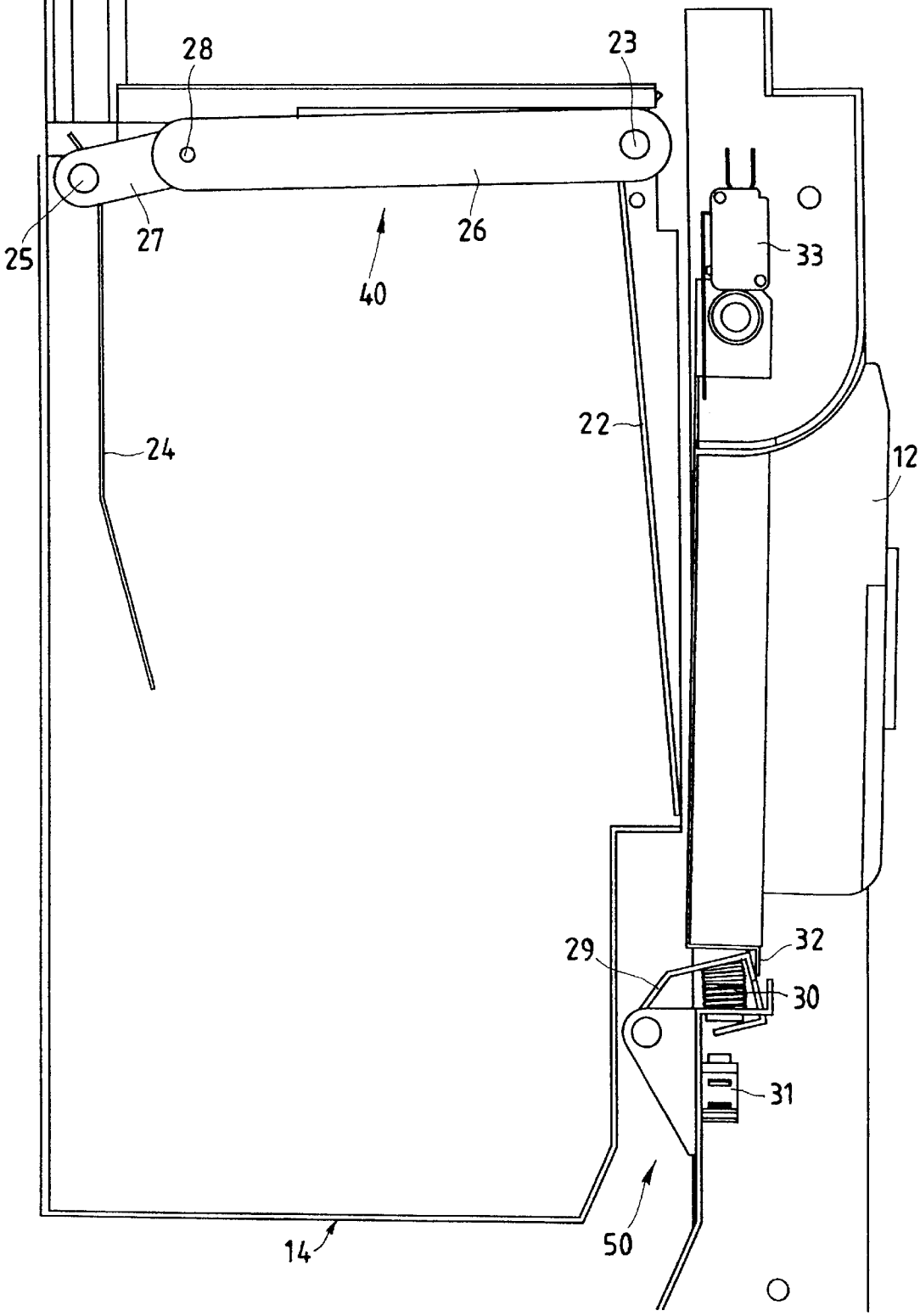
Figure 6:
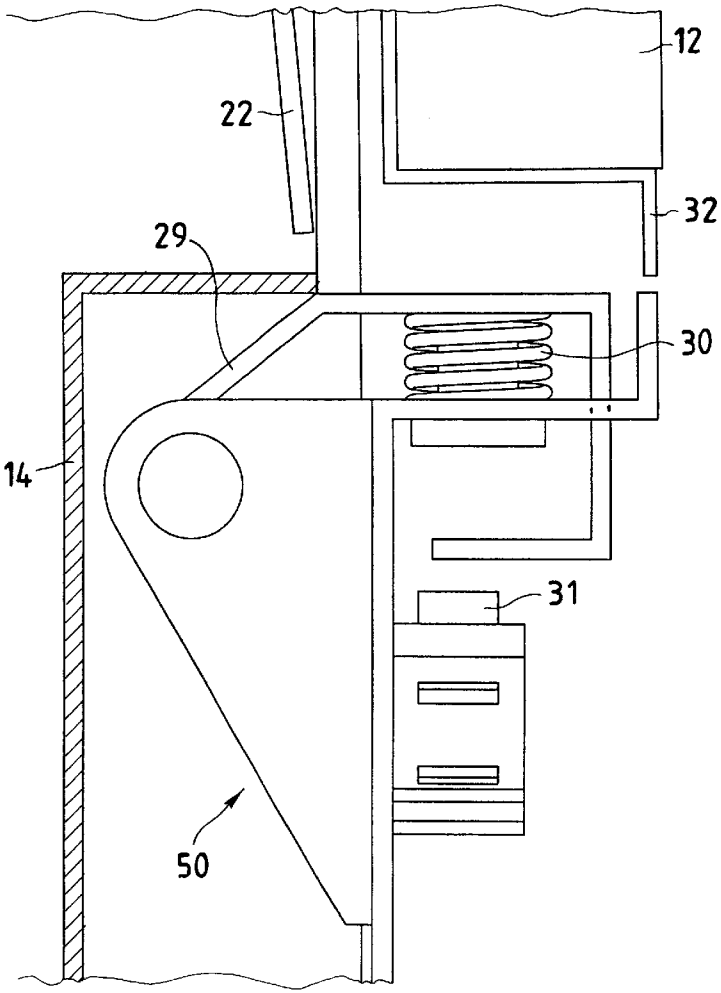
Figure 5:
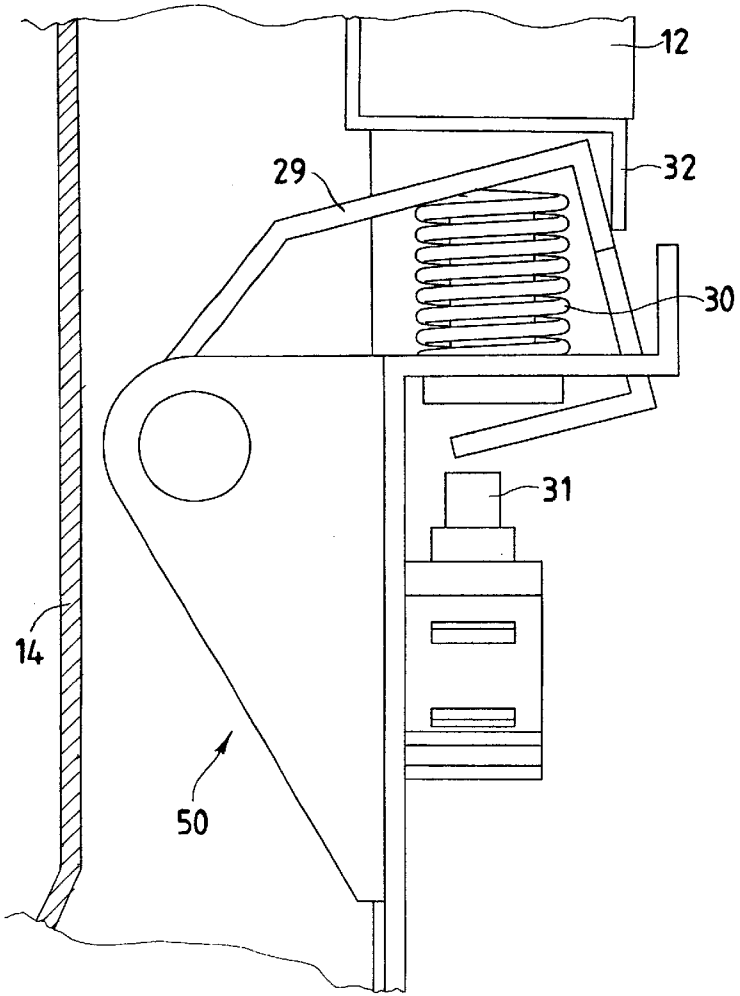

In the drawings:

FIG. 1 offers an overall axonometric view of a first embodiment of this invention, which shows a topside sliding container in a dispensing position facing a product-carrying drawer, and a bottomside collecting pocket accessible by a user through a product collecting door;

FIG. 2 is a side view of FIG. 1,

FIG. 3 is an enlarged axonometric view of a detail of FIG. 1, precisely a self-lubricating block linked to a guide and a belt, FIG. 4 is a partial and enlarged side view of FIG. 1, showing the sliding container near a product collecting position, FIG. 5 offers a side view of an enlarged detail of FIG. 4, showing a door blocking system in a blocking position, FIG. 6 offers a side view of the same enlarged detail of FIG. 5, but at a condition in which the container is in a collecting position; in this position the blocking system turns out to be unblocked.

With reference to the mentioned figures, these show an automatic dispensing machine fitted with a unit for transporting the products from the dispensing point next to a product carrying drawer to the collecting point next to the collecting door, according to this invention.

An automatic dispensing machine offers one or more shelves 10, each being fitted with at least one product carrying drawer 11.

Whenever a product is selected, the machine identifies the product carrying drawer 11 containing it, and allows it to drop, by an expelling system, into the collecting area which is accessible through a door 12. Said door 12 is firmly attached to the machine's fixed structure 13, as shown in FIGS. 1 and 2.

The machine's fixed structure 13, precisely the area facing the product-carrying drawers 11, in the space where the selected products fall into the collecting area, mounts a unit for transporting the products from the dispensing point next to a product carrying drawer to the collecting point set behind the door 12.

Said unit is essentially composed of a sliding container 14 set in front of the selected product carrying drawer 11, receives the product and moves it behind the door 12 to be collected: the FIGS. 1 and 2 show the sliding container 14 in the two mentioned positions.

The motion of the container 14 occurs along two guides 15 which are attached to the lateral walls of the dispensing machine.

Each of said guides 15 holds a sliding block 16 made of a self-lubricating material, for instance polythene, which is laterally attached to the container 14.

On the block 15, the two extremities of a belt 17 are attached while being hooked up in a ring between the two pulleys 21, for instance two punched platelets 18, as shown in FIG. 3.

One of the two belts 17 is controlled by an electric motor 19 and by the relative pulleys; the other belt 17 is shifted in a synchronous manner by the rotating shaft 20, which is linked to the motor 19 by a pulley. The rotation of the shaft of the electric motor 19 thus ultimately controls the vertical motion of the container 14, by shifting the two belts 17 which simultaneously shift the two blocks 16 over the guides 15. The container 14 can therefore position itself opposite the various shelves 10 and into the collecting position behind the door 12.

The motion of the container 14 thus looks like the motion of a lift moving in a vertical manner with respect to the machine.

Considering that the various shelves 10 of the product-carrying drawers 11 may be set apart at a variable distance depending on the products charged, the container 14 is fitted with a small hall-effect probe 34 to detect the position of the shelves 10. This occurs by touch-activating the probe 34 by a magnet 35 positioned on each self 10, as shown in FIG. 2.

In this manner the machine managing program receives the information about the position of the container 14.

The guides 15 are moreover equipped with an upper and a lower stop. Starting from the lower stop, which sets the reference collecting position of the container 14, the machine managing program can, through the probe 34 mounted on the container 14, detect the position of the shelf 10 identified by the magnet 35, where it should position itself to receive the selected product and whence it should subsequently revert to the collecting point.

The container 14 is also equipped with an anti-intrusion mechanism 40, as shown in FIG. 4.

It comprises a front door 22 hinged to the container 14 by a pin 23, and a rear door 24 hinged to the container 14 by a pin 25.

The two doors 22 and 24 are connected by two arm-shaped elements 26 and 27 joined by a pin 28.

In order to collect the product dropped into the container 14 after reaching its collecting position, the door 12 must be pushed in. This action involves lifting the door 22. Through the arm-shaped elements 26 and 27, this action on the door 22 actuates an advance lifting motion of the rear door 24, which goes to close the upper end of the container 14, thus preventing an access by the products contained in the shelves 10.

The entire anti-intrusion mechanism 40 described above automatically closes when falling, whenever the door 12 is no longer pushed.

Finally, there is a mechanism to actuate the blocking system 50 of the door 12. This device 50 allows blocking said door 12 during the motion of the container 14, while unblocking it only when the container 14 is in a collecting position; this is designed to prevent the user from compromising his safety by inserting his hands when the container 14 is about to move.

The mechanism 50 used to to unblock the door 12 comprises a triangular levering system 29 mounted under the door 12 itself. Said levering system 29 is connected to a spring 30 and engages a sensor 31, whenever the sliding container 14 is in a collecting position.

The levering system 29 is kept in a raised position by the extended spring 30. This position blocks the opening of the door 12, by a stop 32 firmly affixed to the door 12 itself, as shown in FIG. 5.

On the other hand, when the container 14 is in a collecting position, the levering system 29 is kept in a lowered configuration by a compressed spring, as shown in FIG. 6. In this position the stop 32 of the door 12 is released from the action of the levering system 29, thus allowing said door 12 to be opened.

In order to render the unit ever more secure, a sensor 31 signalling the position of the levering system 29, and a sensor 33 designed to detect the door's opened or closed position are provided.

The engagement of the sensor 31 placed under the levering system 29 provides the machine managing system with the information that the container 14 is in a collecting position.

The other sensor 33 is set next to the door 12, and if engaged provides the information that said door 12 is closed.

The combination of the information provided by the two sensors 31 and 33 is processed by the machine managing program in such a way that as long as the door 12 remains open, the container 14 stands still, even if a request for a new product collection has arrived.

From the above description in reference to the figures it is obvious that an automatic dispensing machine according to the invention is particularly useful and advantageous. This achieves the purposes mentioned in the premise to the description.

Moreover, a unit according to the invention, designed to transport the products from the dispensing point next to a product carrying drawer up to the collecting point, may be added to an automatic dispensing machine whenever handling any products which advise its use.

By using a unit according to the invention, it is also possible to provide for the opening of several doors to collect the mentioned products, each facing a shelf of the dispensing machine. This limits the time needed to shift the sliding container, which merely needs to be moved to a position to receive the product facing the shelf holding it, without being able to revert to a fixed collecting position.

As an alternative, a single collecting door may be positioned not at a lower but at a central point of the machine, so as to minimize, on the average, the shifting motions needed between the various shelves and the machine' single collecting point.

The shapes of the automatic dispensing machine according to the invention may of course differ from those shown in the drawings, which are offered for merely exemplifying and not limiting purposes. Even the materials employed may be of a most diverse kind, ranging from plastics to metal sheets.

The scope of protection of the invention is therefore outlined by the attached claims.

What is claimed is:

1. A controlled output automatic product dispensing machine, of a type comprising a fixed structure (13) with at least one shelf (10), where at least one product-carrying drawer (11) is installed, and with at least one door (12) to catch the selected product, characterized in that said machine provides at least one guide (15) to slide a container (14) which collects the selected product near the corresponding product carrying drawer (11) and moves it to a collecting position accessible to the user by opening the door (12) said door (12) being fitted with an anti-intrusion system (40) which prevents accessing the product-carrying drawers (11) on the part of the user.

2. A controlled output automatic product dispensing machine according to claim 1, characterized in that said anti-intrusion system (40) comprises a rear door (24) which through arm-type elements (26, 27) and pins (28), shuts off the access to the product carrying drawers (11) whenever the door (12) is opened.

3. A controlled output automatic product dispensing machine, of a type comprising a fixed structure (13) with at least one shelf (10), where at least one product-carrying drawer (11) is installed, and with at least one door (12) to catch the selected product, characterized in that said machine provides at least one guide (15) to slide a container (14) which collects the selected product near the corresponding product carrying drawer (11) and moves it to a collecting position accessible to the user by opening the door (12) wherein said container (14) slides on the guide (15) by a block (16) connected to the container (14) itself, and to a belt (17) moved by an electric motor.

4. A controlled output automatic product dispensing machine, of a type comprising a fixed structure (13) with at least one shelf (10), where at least one product-carrying drawer (11) is installed, and with at least one door (12) to catch the selected product, characterized in that said machine provides at least one guide (15) to slide a container (14) which collects the selected product near the corresponding product carrying drawer (11) and moves it to a collecting position accessible to the user by opening the door (12) wherein said door (12) being fitted with a blocking system (50), which prevents the access to the collecting area whenever the container (14) is not in a collecting position.

5. A controlled output automatic product dispensing machine according to claim 4, wherein said blocking system (50) comprises a triangular leverage system (29) and an extended spring (30), which prevents the opening of the door (12), by using a stop (32) firmly attached to the door itself, whenever the container (14) is not in a collecting position and therefore not acting to compress the spring (30).

6. A controlled output automatic product dispensing machine, of a type comprising a fixed structure (13) with at least one shelf (10), where at least one product-carrying drawer (11) is installed, and with at least one door (12) to catch the selected product, characterized in that said machine provides at least one guide (15) to slide a container (14) which collects the selected product near the corresponding product carrying drawer (11) and moves it to a collecting position accessible to the user by opening the door (12) wherein said container (14) advises the machine man aging system of its position based on the information originating from a probe firmly attached to the container (14) itself, which identifies the shelves (10) of the machine.

* * * * *